United States Patent [19]

VanSickle

[11] 4,437,625

[45] Mar. 20, 1984

[54] COIL ADAPTER REEL

[76] Inventor: Eugene R. VanSickle, Rte. #3, Box 190, Dover, Tuscarawas County, Ohio 44622

[21] Appl. No.: 424,380

[22] Filed: Sep. 27, 1982

[51] Int. Cl.[3] ..... B65H 49/00

[52] U.S. Cl. ..... 242/129; 242/105

[58] Field of Search ..... 242/54 R, 105, 110, 242/110.3, 129, 85, 85.1, 127; 314/68–71; 219/130

[56] References Cited

U.S. PATENT DOCUMENTS

| | | | |
|---|---|---|---|
| 701,317 | 6/1902 | English | 242/115 |
| 742,296 | 10/1903 | Delphey | 242/110.3 |
| 3,395,308 | 7/1968 | Meyer | 314/68 |
| 3,446,456 | 5/1969 | Wyle | 242/129 |
| 3,652,028 | 3/1972 | Ukai et al. | 242/129 |
| 3,815,837 | 6/1974 | Guthrie | 242/54 R |

FOREIGN PATENT DOCUMENTS

| | | | |
|---|---|---|---|
| 226866 | 3/1959 | Australia | 242/129 |

*Primary Examiner*—Leonard D. Christian

*Attorney, Agent, or Firm*—Oldham, Oldham, Hudak, Weber & Sand Co.

[57] ABSTRACT

An adapter reel of the type which is mounted on a hub of a machine for holding and dispensing a coil of wire. The reel has a central tubular sleeve which is adapted to be slidably mounted on a machine hub. A plurality of base plates are mounted on the sleeve and extend radially outwardly in a spokelike fashion. A coil holding arm assembly is movably mounted on each of the base plates for receiving and holding a coil of wire. Each arm assembly includes an inverted L-shaped rod attached to a sleeve which is slidably and pivotally mounted on an upstanding post which is attached to the base plate. The sleeves and rods are movable between locked and unlocked positions. A lower end of the rod extends beyond the lower end of the sleeve and is engageable in a hole formed in the base plate to lack the arm in a coil holding position. A wing nut is mounted on a top threaded end of each post and clamps the sleeve against the base plate to maintain the rod end in the hole of the base plate preventing premature rotation of the coil retaining rod.

6 Claims, 7 Drawing Figures

COIL ADAPTER REEL

BACKGROUND OF THE INVENTION

1. Field of the Invention

The invention relates to reels for holding and dispensing coils of wire upon rotation of the reel. More particularly, the invention relates to an adapter reel for mounting on the hub of a machine for holding a coil of wire and to such a reel having an improved locking arrangement for the coil retaining arms.

2. Description of the Prior Art

Various types of automatic welding machines use consumable electrode wire. This wire generally is supplied in coils weighing approximately twenty-five pounds each. The coils are mounted on a rotatable hub on the welding machine or wire feeder mechanism therefor which automatically dispenses the wire as the wire is being consumed during welding operations. The price per pound of these small twenty-five pound coils is considerably higher than the price per pound of such wire on larger coils weighing sixty or seventy pounds. Therefore, it is more economical to use the heavier coils of wire which result in a savings in cost of wire in addition to reducing the downtime of the machine for adding a new coil of wire.

There was no known readily available adapter reel of which I am aware which can be placed on these welding machines and wire feeder mechanisms for receiving the larger coils of wire prior to my development of an adapter reel of which the subject invention is an improvement thereon. My earlier reel construction is similar in many respects to the improved reel described below and shown in the drawings except that it is provided with an improved locking arrangement for securing the coil retaining arms in their coil holding position. Occasional problems were encountered with my earlier adapter reel in that it was difficult to securely clamp the coil holding posts in their coil supporting position by a wing nut. Occasionally the arms would become loosened and turn on their supporting posts and release their support of the coil.

Therefore, the need has existed for a means of locking the coil supporting arms in a locked or coil securing position. The only type of locking mechanism of which I am aware is the use of a stud formed on a pivot post which is engaged in a longitudinal slot formed in the pivot sleeve. Although this construction apparently performs its desired purpose, my locking mechanism provides a stronger locking arrangement at a lower cost. Thus, my improved locking arrangement for the coil supporting arms on my improved adapter reel construction is believed to satisfy the existing needs.

SUMMARY OF THE INVENTION

Objectives of the invention include providing an improved coil adapter reel which is mountable on the reel mounting hub of a machine such as an automatic welder or wire feeder mechanism for holding a larger coil of welding wire than that intended to be held by the usual machine reel, which electrode wire is automatically dispensed from the reel as the wire is consumed during a welding operation by rotation of the machine hub. Another objective is to provide such an improved reel which is of an extremely simple, inexpensive and rugged construction, and which has improved locking means for securing the reel holding arms in locked position preventing premature movement of the arms toward an open position.

Still another objective is to provide such an adapter reel having the improved locking means which requires only a minimum amount of modification to an existing adapter reel heretofore so successful in use, which requires only the modification of the sleeve and inverted L-shaped rod of each of the coil holding arm assemblies and the forming of a small hole adjacent the pivot post on each of the base plates of the reel for receiving an end of the inverted L-shaped member to securely lock the arm assemblies in closed position, and which eliminates excessive tightening of a wing nut on top of the post as heretofore required for locking the arms in closed position. A further objective is to provide such an improved coil adapter reel which eliminates problems existing in the art, satisfies needs, and obtains new results in the art.

These objectives and advantages are obtained by the improved reel construction of the invention, the general nature of which may be stated as being of the type adapted to be mounted on the hub of a machine for holding and dispensing a coil of wire, said construction including hub means for mounting the improved reel on a machine hub; a plurality of spaced, radially outwardly extending base plates mounted on the hub means; an upstanding post mounted on each of the base plates and extending generally parallel to the axis of the hub means; a locking hole formed in each of the base plates adjacent the post; arm means mounted on each of the posts for removably holding a coil of wire, each of said arm means including a sleeve telescopically movably mounted on a respective post, and an inverted L-shaped rod attached to said sleeve; and each of said rods having a radially outwardly extending leg portion spaced from and parallel with the base plates providing a coil receiving zone therebetween when the arm means is in a coil holding position, and a lower leg portion engageable in the base plate hole to secure the arm means in the coil holding position.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
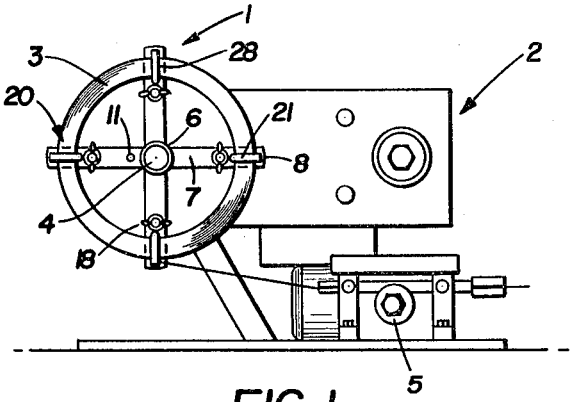
FIG. 1 is a diagrammatic side elevational view of a wire feeder for an automatic welding machine with the improved coil adapter reel mounted thereon.
Figure 7:
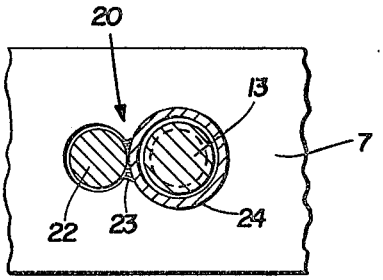
FIG. 7 is an enlarged fragmentary sectional view taken on line 7—7, FIG. 3.

The improved coil adapter reel is indicated generally at 1, and is shown in FIG. 1 mounted on an automatic wire feeder 2 for a welding machine or the like. Reel 1 is adapted to hold a coil 3 of consumable welding wire which is fed to a welder as required by the positive driving action of feed wheel 5 of wire feeder 2. The details of construction and configuration of improved reel 1 is shown particularly in FIGS. 2 and 3.

Figure 2:
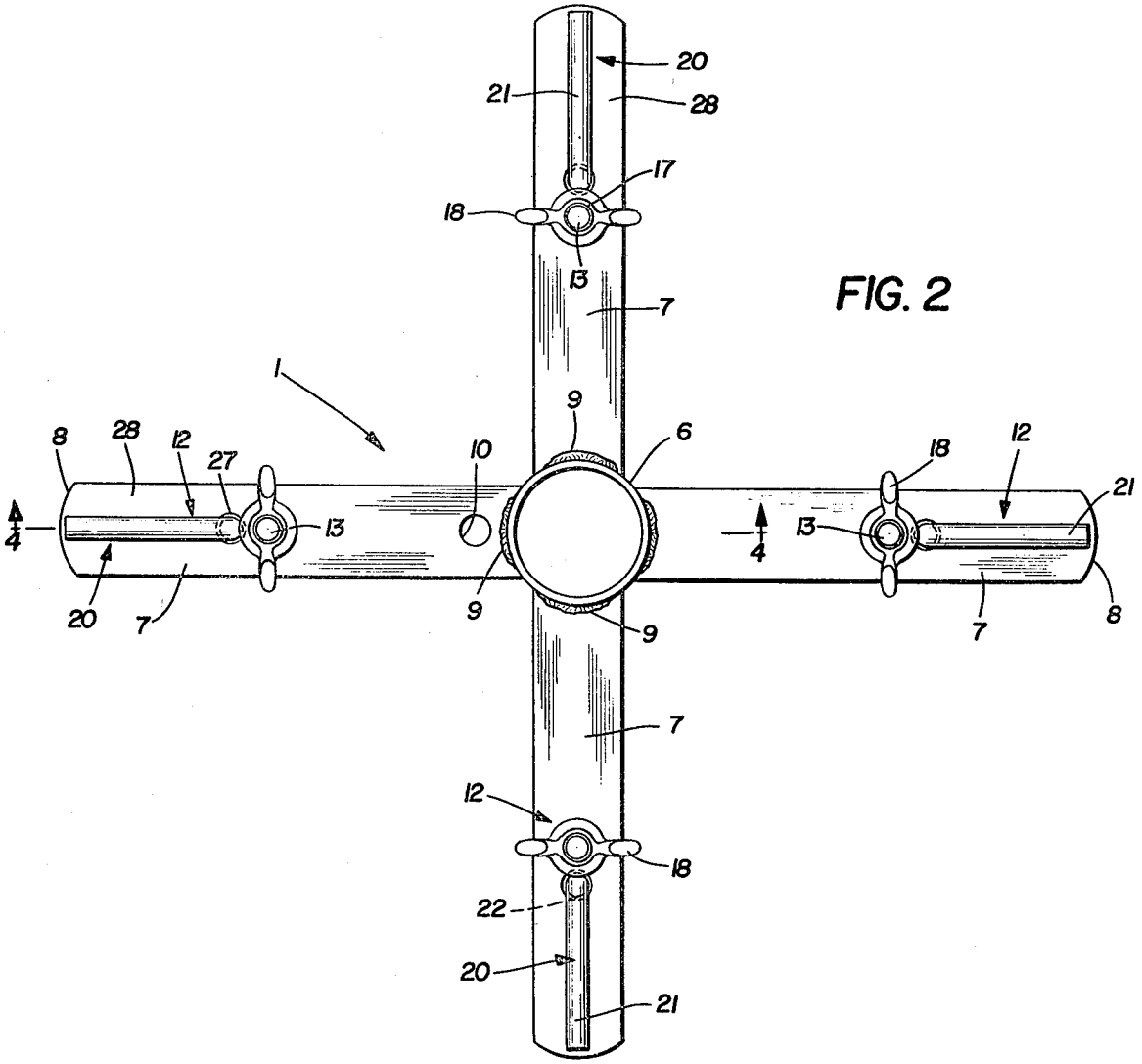
FIG. 2 is an enlarged top plan view of the improved adapter reel of FIG. 1 removed from the wire feeder.

Adapter reel 1 includes a hollow, cylindrical-shaped tubular sleeve 6 which forms the mounting hub for reel 1, and which is telescopically slidably mounted on hub 4 of wire feeder 2. A plurality of base plates 7 are mounted on the lower end of hub 6 and extend in a radially outward direction forming a spokelike configuration as shown in FIG. 2. Four base plates 7 are shown for the particular embodiment of reel 1 that is shown in the drawings, each of which is spaced 90° with respect to the adjacent plate 7 and forming a pair of perpendicularly intersecting members. Base plates 7 are generally rectangularly-shaped flat metal bars approximately one quarter inch thick with their outer ends 8 being rounded to prevent injury to a machine operator. Plates 7 preferably are attached to hub 6 by welds 9. A hole 10 is formed in one of the base plates 7 adjacent hub 6 through which a connection pin 11 of wire feeder 2 (FIG. 1) extends to provide a positive connection between reel 1 and feeder hub 4.

Figure 4:
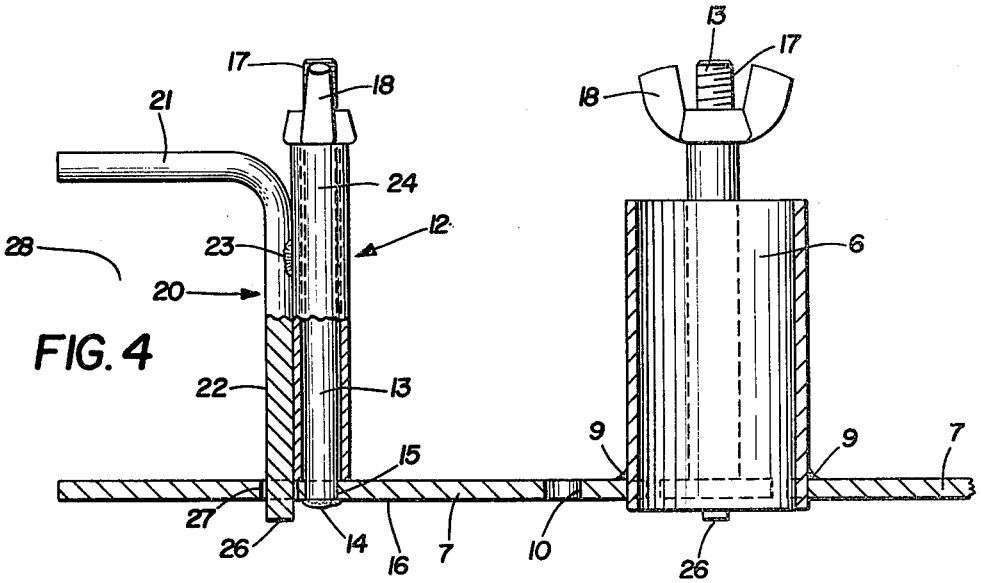
FIG. 4 is an enlarged fragmentary sectional view taken on line 4—4, FIG. 2 with the coil holding arm assemblies being shown in locked position.

A coil holding arm assembly indicated generally at 12, is mounted on each of the base plates 7 inwardly a predetermined distance from outer ends 8. Each arm assembly 12 is similar to each other as well as its position on its respective base plate 7. Therefore, only one arm assembly 12 is described in detail. Each arm assembly 12 includes a post 13 which is rigidly mounted on its respective plate 7 by a weld 14. Post 13 extends upwardly from plate 7 parallel with the central axis of hub 6. Post 13 preferably is seated in a hole 15 formed in base plate 7 with weld 14 being applied to the bottom surface 16 of the base plates (FIG. 4). The top end 17 of each post 13 is threaded and a wing nut 18 is adjustably mounted thereon.

Figure 6:
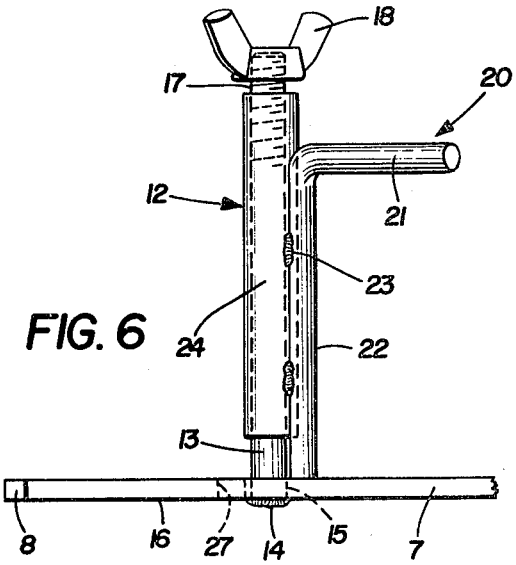
FIG. 6 is a fragmentary elevational view looking in the direction of arrows 6—6, FIG. 5.

Each arm assembly 12 further includes an inverted L-shaped rod 20 having a coil retaining portion 21 and a locking portion 22, and a hollow sleeve 24. Rod portion 22 is attached by welds 23 at various space locations to sleeve 24. Sleeve 24 is slidably pivotally mounted on post 13 as shown in FIGS. 4 and 6. Wing nut 18 retains sleeve 24 and correspondingly L-shaped rod 20 on post 13.

Figure 3:
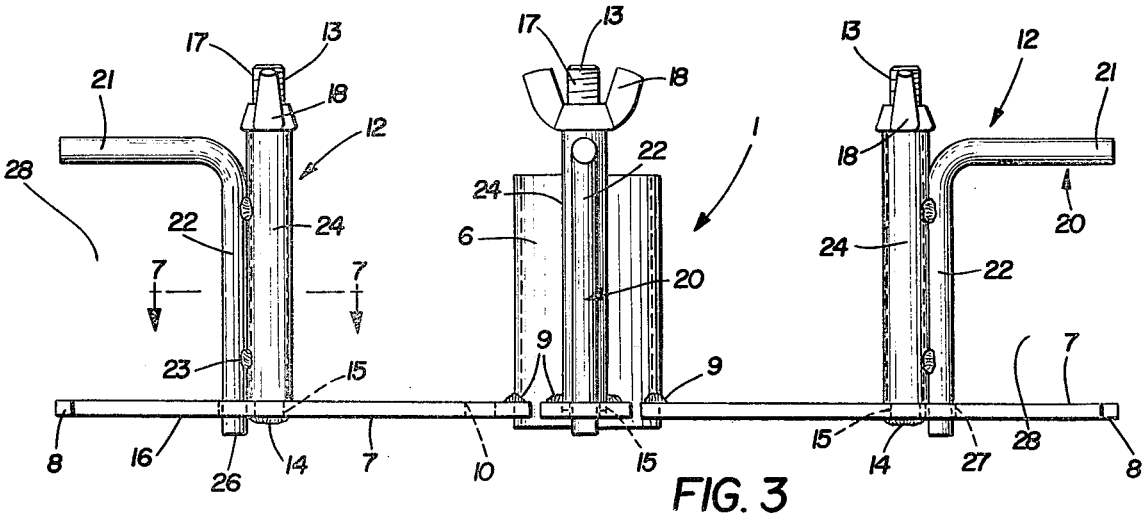
FIG. 3 is a side elevational view of the adapter reel shown in FIG. 2.

In accordance with the invention, a hole 27 is formed in each base plate 7 closely adjacent to and radially outwardly beyond each post 13 for receiving an extended end 26 of rod 20 to lock coil holding arm assembly 12 in a locked position as shown in FIGS. 3 and 4. When in the locked position of FIGS. 3 and 4, rod portion 21 extends parallel with the outer end portion of base plate 7 and is spaced therefrom forming a coil receiving area 28 therebetween in which coil 3 is located.

Figure 5:
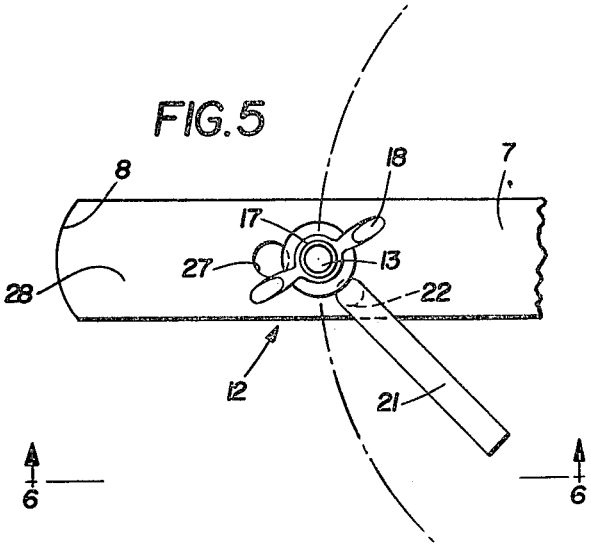
FIG. 5 is a fragmentary top plan view of one of the arm assemblies shown in an unlocked position.

The manner of use of improved coil adapter reel 1 is described in detail below. Reel 1 is mounted on wire feeder hub 4 by the telescopic sliding engagement of reel hub 6 on hub 4 with pin 11 projecting through hole 10 to provide a positive connection between hubs 1 and 4. Arm assemblies 12 are moved to an unlocked or coil receiving position (FIG. 5) by loosening the clamping engagement of wing nuts 18 against the top edges of sleeves 24 enabling sleeves 24 to be raised from plates 7 which disengage rod ends 26 from within holes 27. Sleeves 24 and attached inverted L-shaped rods 20 then are pivoted about posts 13 to the open position as shown in FIG. 5 enabling a wire coil 3 to be placed on base plates 7 with its inside diameter adjacent to and in contact with sleeves 24. After coil 1 is placed on arm assemblies 12, rods 20 are rotated to the coil holding position of FIGS. 2 and 4 with rod ends 26 being inserted into holes 27. Wing nuts 18 then are clamped against the top edges of sleeves 24 locking rod ends 26 in holes 27.

This improved locking arrangement prevents premature rotation of arm assemblies 12 and eliminates excess clamping pressure being applied to wing nuts 18 as heretofore required to clamp sleeves 24 tightly against the top surface of base plate 7. Wing nuts 18 need only be advanced downwardly along threaded ends 17 of posts 13 sufficiently to limit upward movement of sleeves 24 so that rod ends 26 cannot become disengaged from holes 27.

Improved adapter reel 1 has a number of advantages. It is a relatively simple and lightweight, yet highly efficient device, formed of readily available components which are rigidly assembled by usual welding procedures; it provides an extremely satisfactory and efficient locking means preventing premature rotation of the coil holding arm assemblies from locked positions; it requires only the loosening of one or more wing nuts for installing a new coil of wire on the reel; it eliminates excessive force from being applied by the wing nuts on the sleeves of the arm assemblies to retain the arm assemblies in locked positions as heretofore required; and it eliminates expensive and complicated mechanisms to achieve the locking feature.

Accordingly, the improved reel construction is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the coil adapter reel is constructed and used, the characteristics of the construction, and the advantageous, new and useful results obtained; the new and useful structures, devices, elements, arrangements, parts, and combinations, are set forth in the appended claims.

I claim:

1. An improved reel construction of the type adapted to be mounted on the hub of a machine for holding and dispensing a coil of wire, said construction including:

(a) hub means for mounting the improved reel on a machine hub;

(b) a plurality of spaced, radially outwardly extending base plates mounted on the hub means;

(c) an upstanding post mounted on each of the base plates and extending generally parallel to the axis of the hub means;

(d) a locking hole formed in each of the base plates adjacent the post;

(e) arm means mounted on each of the posts for removably holding a coil of wire, each of said arm means including a sleeve telescopically movably mounted on a respective post, and an inverted L-shaped rod attached to said sleeve; and (f) each of said rods having an outwardly extending portion spaced from and parallel with the base plates providing a coil receiving zone therebetween when the arm means is in a coil holding position, and a lower portion engageable in the base plate hole to secure the arm means in the coil holding position.

2. The reel construction defined in claim 1 in which each of the upstanding posts has a threaded outer end which extends beyond the sleeve of the arm means when said arm means is in the coil holding position; and in which a nut is adjustably mounted on the threaded end of each of the posts and is clampingly engageable with the top of its respective sleeve to retain the arm means in the coil holding position.

3. The reel construction defined in claim 1 in which the hub means is a hollow tubular sleeve; and in which there are four base plates mounted on the sleeve spaced 90° from each other.

4. The reel construction defined in claim 1 in which the lower portion of the rod engageable with the locking hole extends beyond the sleeve a distance equal to or greater than the thickness of the base plate.

5. The reel construction defined in claim 1 in which the base plates are flat, generally rectangularly-shaped metal members.

6. The reel construction defined in claim 1 in which a hub pin hole is formed in one of the base plates adjacent the hub means.

* * * * *